US011713537B2

(12) United States Patent
Park

(10) Patent No.: US 11,713,537 B2
(45) **Date of Patent: *Aug. 1, 2023**

(54) CLOTHES TREATMENT APPARATUS

(71) Applicant: LG Electronics Inc., Seoul (KR)

(72) Inventor: Jiyeon Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 47 days.

This patent is subject to a terminal disclaimer.

(21) Appl. No.: 17/353,146

(22) Filed: Jun. 21, 2021

(65) Prior Publication Data

US 2021/0310181 A1 Oct. 7, 2021

Related U.S. Application Data

(63) Continuation of application No. 16/274,367, filed on Feb. 13, 2019, now Pat. No. 11,060,237.

(30) Foreign Application Priority Data

Feb. 22, 2018 (KR) ..... 10-2018-0021194

(51) Int. Cl.
*D06F 58/10* (2006.01)
*D06F 71/29* (2006.01)
(Continued)

(52) U.S. Cl.
CPC ..... *D06F 58/10* (2013.01); *D06F 67/005* (2013.01); *D06F 71/29* (2013.01); *D06F 71/36* (2013.01); *D06F 71/40* (2013.01); *D06F 73/02* (2013.01)

(58) Field of Classification Search
CPC ..... D06F 58/10; D06F 58/16; D06F 67/00; D06F 67/005; D06F 71/29; D06F 71/36;
(Continued)

(56) References Cited

U.S. PATENT DOCUMENTS 1,763,816 A 6/1930 Pauly
3,117,704 A 1/1964 McMillan
(Continued)

FOREIGN PATENT DOCUMENTS

EP 2826911 1/2015
EP 3034684 6/2016
(Continued)

OTHER PUBLICATIONS

European Search Report dated Jun. 14, 2019.
European Search Report dated Nov. 12, 2020.

*Primary Examiner* — Ismael Izaguirre
(74) *Attorney, Agent, or Firm* — Birch, Stewart, Kolasch & Birch LLP

(57) ABSTRACT

A clothes treatment apparatus includes a cabinet defining a treatment chamber in which clothes are treated. A door is coupled to the cabinet and a pants crease management apparatus is disposed on a rear surface of the door. The pants crease management apparatus includes a press plate coupled to the rear surface of the door, a press door coupled to the press plate, and a film disposed between the press plate and the press door. The film can be placed between side portions of pants when pressed in between the press plate and the press door in a process to remove wrinkles from the pants and put a crease in the pants.

34 Claims, 8 Drawing Sheets

(51) Int. Cl.

| | |
|---|---|
| ***D06F 71/36*** | (2006.01) |
| ***D06F 71/40*** | (2006.01) |
| ***D06F 73/02*** | (2006.01) |
| ***D06F 67/00*** | (2006.01) |

(58) Field of Classification Search
CPC ..... D06F 71/40; D06F 71/295; D06F 71/30; D06F 71/34; D06F 73/00; D06F 73/02
See application file for complete search history.

(56) References Cited

U.S. PATENT DOCUMENTS

| | | | | |
|---|---|---|---|---|
| 3,425,141 | A | 2/1969 | Petrich | |
| 4,611,419 | A * | 9/1986 | Duplessy | A47G 25/72 38/21 |
| 4,694,146 | A | 9/1987 | DeMars | |
| 5,305,484 | A | 4/1994 | Fitzpatrick | |
| 5,359,792 | A | 11/1994 | Hanada | |
| 5,970,637 | A | 10/1999 | Mohan | |
| 7,032,336 | B2 | 4/2006 | Bedretdinov | |
| D732,774 | S | 6/2015 | Chung | |
| 9,359,717 | B2 | 6/2016 | Lim | |
| 11,060,237 | B2 * | 7/2021 | Park | D06F 71/36 |
| 2013/0097896 | A1 | 4/2013 | Moon | |
| 2015/0020419 | A1 | 1/2015 | Park | |

FOREIGN PATENT DOCUMENTS

| | | | | |
|---|---|---|---|---|
| EP | 0761866 | A1 * | 5/2018 | |
| EP | 3321414 | A1 * | 5/2018 | D06F 35/00 |
| FR | 1336446 | A | 8/1963 | |
| JP | 10-192599 | A | 7/1998 | |
| JP | 2001-58100 | A | 3/2001 | |
| KR | 20120091799 | A * | 8/2012 | |
| KR | 10-2016-0075032 | A | 6/2016 | |
| KR | 10-2017-0084454 | | 7/2017 | |
| WO | WO-2008007200 | A1 * | 1/2008 | D06F 71/29 |

* cited by examiner

CLOTHES TREATMENT APPARATUS

CROSS REFERENCE TO RELATED APPLICATION

The present application is a continuation of U.S. patent application Ser. No. 16/274,367, filed on Feb. 13, 2019, which claims the benefit of priority to Korean Patent Application No. 10-2018-0021194, filed on Feb. 22, 2018, the entire contents of all of which are incorporated herein in their entireties for all purposes by this reference.

BACKGROUND

Field

The present disclosure relates to a clothes treatment apparatus.

Discussion of the Related Art

A clothes treatment apparatus refers to an apparatus for managing clothes such as washing, drying or wrinkle reduction of clothes in the home or at a laundry. For example, the clothes treatment apparatus includes a washing machine for washing clothes, a dryer for drying clothes, a washing and drying machine for performing a washing function and a drying function, a refresher for refreshing clothes, and a steamer for reducing unnecessary wrinkles of clothes.

A refresher is an apparatus for making the condition of clothes pleasant and fresh, and performs a function for drying clothes, supplying fragrance, preventing static electricity from occurring in clothes, or reducing wrinkles of clothes.

The steamer is an apparatus for supplying steam to clothes to remove wrinkles of the clothes. The steamer removes wrinkles of clothes without directly applying heat to the clothes like a general iron.

The clothes treatment apparatus including the functions of the refresher and the steamer may perform a function for removing wrinkles and odors of clothes received therein using steam and hot air.

The clothes treatment apparatus may include a pants crease management apparatus for putting a crease in pants received therein. Due to the features of the pants, it is difficult to accurately align both portions (a portion into which a left leg is fitted and a portion into which a right leg is fitted) of the pants in the pants crease management apparatus.

Accordingly, it is necessary to firmly fix the pants in the pants crease management apparatus in a state in which both portions, in which creases need to be put, of the pants are aligned.

However, in a conventional pants crease management apparatus, both portions of the pants are not firmly fixed and thus are moved by steam or hot air. When a creasing process is performed in this state, creases may be put in a direction undesired by a user, thereby causing wrinkles.

RELATED ART DOCUMENT

Patent Document

1. Publication No. (Publication Date) 10-2017-0084454 (Jul. 20, 2017)
2. Title: Clothes treatment apparatus SUMMARY An object of the present disclosure is to provide a clothes treatment apparatus including a pants crease management apparatus capable of firmly fixing both portions of pants.

In particular, another object of the present disclosure is to provide a clothes treatment apparatus capable of easily fixing pants by providing a film for pressing both portions of the pants.

In addition, another object of the present disclosure is to provide a clothes treatment apparatus capable of pressing pants while a film is not easily deformed by heat, by optimally setting a material or thickness of the film.

In addition, another object of the present disclosure is to provide a clothes treatment apparatus capable of enabling a user to easily operate a film and pants while both portions of the pants are pressed by the film, by improving the structure of the film.

In addition, another object of the present disclosure is to provide a clothes treatment apparatus including a film movably provided in a state of being firmly supported by a pants crease management apparatus.

A clothes treatment apparatus according to an embodiment of the present disclosure includes a pants crease management apparatus provided on a rear surface of a door, thereby removing wrinkles of pants and putting a crease in the pants.

The pants crease management apparatus includes a film disposed between a press plate and a press door and sandwiched between both portions of the pants P, and the film is configured to press both portions of the pants P, thereby easily putting a crease in the pants.

Since the film is formed of a flexible material and has a relatively small thickness, the film can be easily manipulated and apply excellent pressing force to the pants.

The film includes a plurality of film portions fixed to both sides of the press plate, thereby easily inserting the plurality of film portions into the pants P.

The film includes a first film portion fixed to one side of the press plate and a second film portion fixed to the other side of the press plate.

The film is hooked to the press plate.

The film includes a film body located on a front side of the press plate and a film fixing portion extending backward from the film body and coupled to a back surface of the press plate.

The first film portion and the second film portion are disposed to be symmetrical with respect to a vertical center line l1 of the press plate.

A first side end forming a right end of the first film portion and a second side end forming a left end of the second film portion are spaced apart from each other.

An inclined surface inclined downward toward the first side end is formed in an upper end of the first film portion, and the inclined surface is inclined from the upper end of the press plate by a set angle θ1.

An inclined surface inclined downward toward the second side end is formed in an upper end of the second film portion, and the inclined surface is inclined from the upper end of the press plate by a set angle θ1.

A latch provided on the press door and a latch coupling portion provided on the door and coupled to the latch may be further included.

The film includes a film cut-out recessed from one surface of the film, and the latch coupling portion is located in the film cut-out.

A clothes treatment apparatus according to another embodiment of the present disclosure includes a press plate, a press door coupled to the press plate and a flexible film movably disposed between the press plate and the press door.

DETAILED DESCRIPTION

Hereinafter, the embodiments of the present disclosure will be described with reference to the accompanying drawings. It is to be understood, however, that the scope is not limited to the disclosed embodiments, and those skilled in the art may easily suggest other embodiments within the same scope of the idea.

Figure 1:
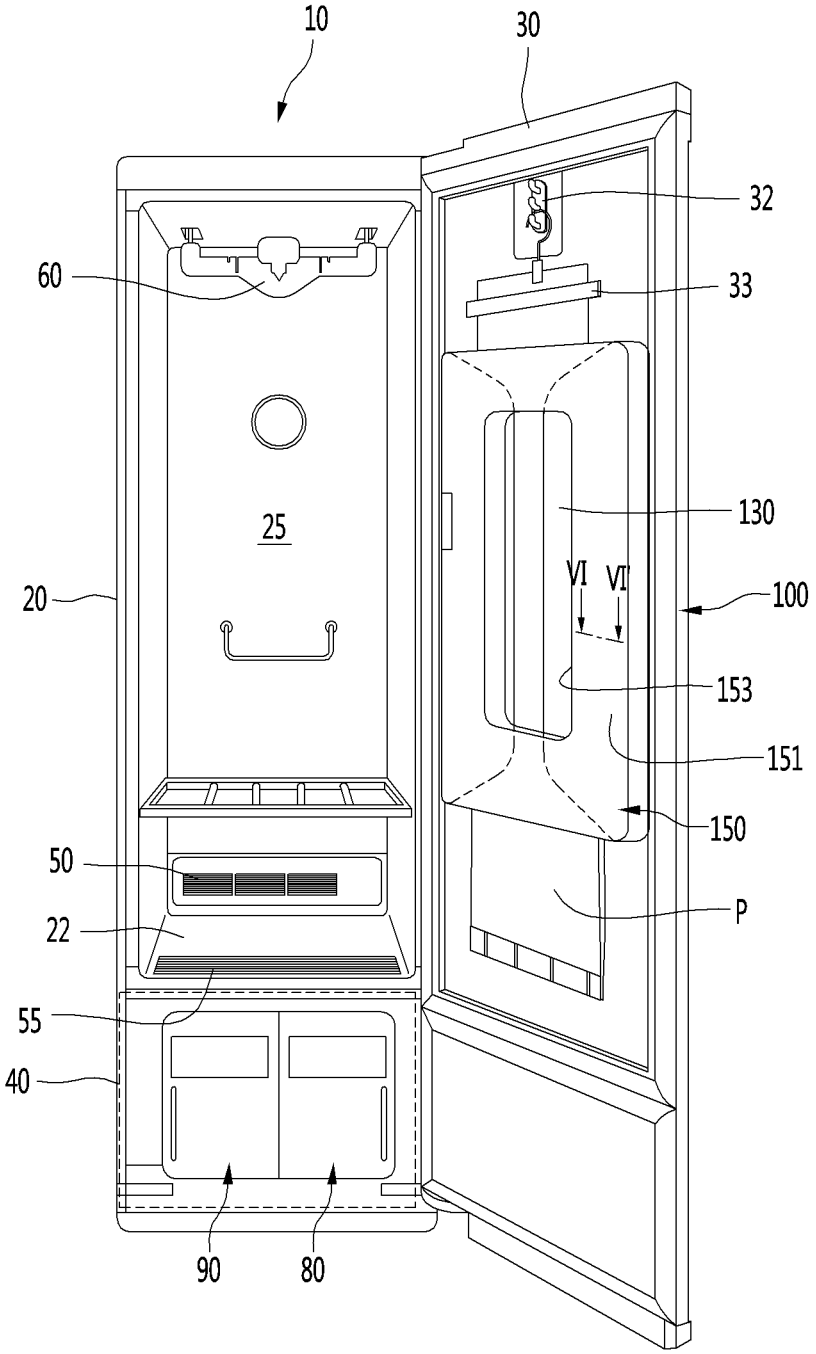
FIG. 1 is a diagram showing the configuration of a clothes treatment apparatus according to an embodiment of the present disclosure.
Figure 2:
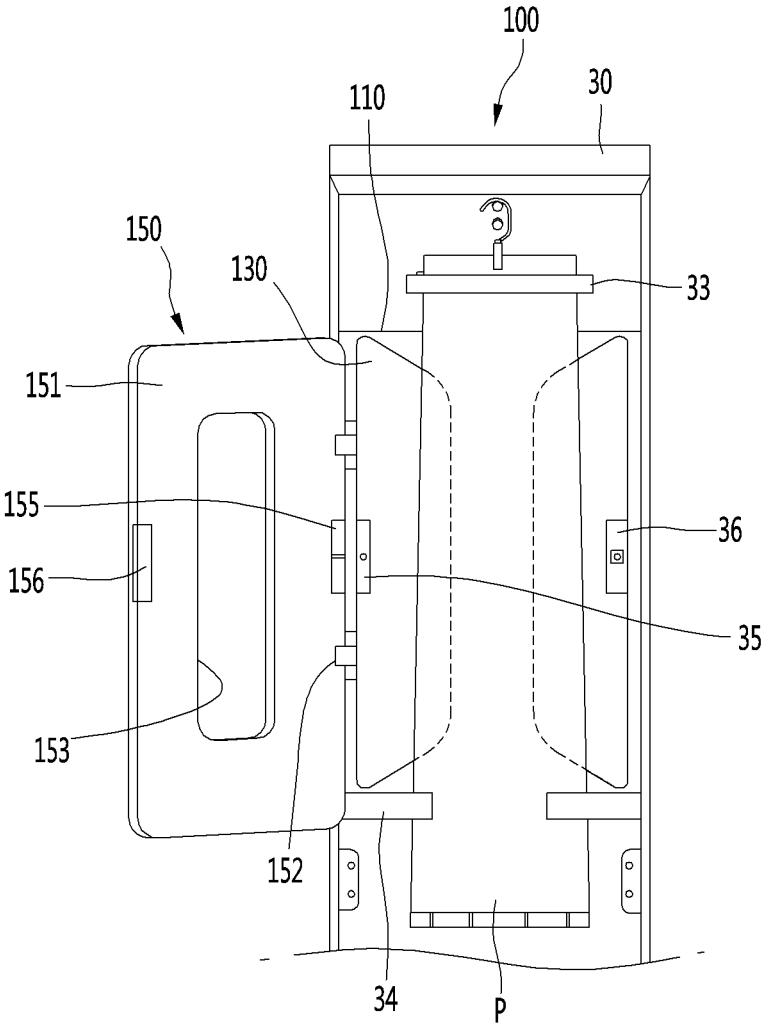
FIG. 2 is a diagram showing a state in which a press door of a pants crease management apparatus according to an embodiment of the present disclosure is opened.

FIG. 1 is a diagram showing the configuration of a clothes treatment apparatus according to an embodiment of the present disclosure, and FIG. 2 is a diagram showing a state in which a press door of a pants crease management apparatus according to an embodiment of the present disclosure is opened.

Referring to FIGS. 1 and 2, the clothes treatment apparatus 10 according to the embodiment of the present disclosure includes a cabinet 20.

The cabinet 20 includes a treatment chamber 25 in which clothes are received to remove wrinkles or odors of clothes through steam or air circulation and a machine room 40 disposed below the treatment chamber 25 and having a plurality of parts for clothes treatment.

The cabinet 20 includes a partition plate 22 for partitioning the treatment chamber 25 and the machine room 40. The treatment chamber 25 may be formed above the partition plate 22 and the machine room 40 may be formed below the partition plate 22.

The treatment chamber 25 may be defined by a space formed by the inner walls of the cabinet 20. For example, the treatment chamber 25 may be defined by a space formed by the upper wall, the upper portions of the left and right walls and the upper portion of the rear wall of the cabinet 20. In addition, the machine room 40 may be defined by a space formed by the lower wall, the lower portions of the left and right walls and the lower portion of the rear wall of the cabinet 20.

A clothes hanger 60 for hanging a hanger for hanging clothes is provided inside the cabinet 20. The clothes hanger 60 may be disposed on the upper portion of the treatment chamber 25. The clothes hanger 60 may be configured to be moved in a plurality of directions by a driving device such as a motor. For example, the plurality of directions includes a front-and-back direction, an upper-and-lower direction and a left-and-right direction.

The clothes treatment apparatus 10 further includes a discharging portion 50 for discharging steam or heated air (hot air) into the treatment chamber 25. For example, the discharging portion 50 may be formed in a portion where the rear wall of the cabinet 20 and the rear portion of the partition wall 22 meet.

The clothes treatment apparatus 10 further includes an inlet 55 for discharging, toward the machine room 40, air in the treatment chamber 25 and, more particularly, air including moisture, contaminant particles and odor particles after treating clothes in the treatment chamber 25. The inlet 55 may be formed in the front portion of the partition plate 22.

The clothes treatment apparatus 10 may include a plurality of tanks 80 and 90 disposed on the front portion of the machine room 40. The plurality of tanks 80 and 90 may include a water supply tank 80 for supplying water to a steam generation apparatus (not shown). Water of the water supply tank 80 may be supplied to the steam generation apparatus through a water supply pump (not shown). The steam generation apparatus may be provided in the machine room 40.

The plurality of tanks 80 and 90 may further include a drain tank 90 for collecting and storing condensate water generated in the treatment chamber 25 or condensate water generated in a heat pump device (not shown). Condensate water generated in the heat pump device may flow into the drain tank 90 through a drain pump (not shown). The heat pump device may be provided in the machine room 40.

The water supply tank 80 and the drain tank 90 are exposed at the lower portion of the clothes treatment apparatus 10 when a door is opened and may be detached by a user. The user may detach the water supply tank 80 to supply water or detach the drain tank 90 to remove water stored in the drain tank 90.

The clothes treatment apparatus 10 further includes a door 30 for opening or closing the treatment chamber 25. For example, the door 30 may be disposed on the front side of the cabinet 20 and may be rotatably coupled to the cabinet 20.

A pants crease management apparatus 100 for removing wrinkles of pants may be provided on a rear surface, that is, an inner surface, of the door 30. A pants hanger 32 for hanging a hanger 33 for hanging pants is provided above the pants crease management apparatus 100. The user may hang pants on the hanger and then hang the hanger on the pants hanger 32.

The pants may be hanged on the pants crease management apparatus 100 to be flattened and fixed. During operation of the clothes treatment apparatus 10, steam or hot air may be supplied to the pants crease management apparatus 100 such that wrinkles of the pants are removed and a crease may be put in a desired direction.

The pants crease management apparatus 100 includes a press plate 110 coupled to the rear surface of the door 30 and a press door 150 coupled to the front side of the press plate 110. The press plate 110 or the press door 150 may be made of a metal or plastic material.

In FIG. 2, the pants P hanged on the pants hanger 32 are placed on the front side of the press plate 110 and the door 150 may be closed in front of the pants P. The pants P are pressed between the press plate 110 and the press door 150. In this process, a crease may be put in the pants P. That is, the pants P is placed in the pants crease management apparatus 100, thereby being ironed.

The press door 150 includes a door body 151 having a through-hole 153 formed therein. The through-hole 153 is formed at a substantially central portion of the door body 151 and steam or hot air present in the treatment chamber 25 may be applied to the pants P hanged on the back side of the press door 150 through the through-hole 153.

The press door 150 may be rotatably coupled to the door 30.

Specifically, the press door 150 includes a hinge 152 coupled to the door 30. The hinge 152 may be provided on one side, for example, the left side, of the door body 151. A plurality of hinges 152 may be provided. The plurality of hinges 152 may be arranged on the left side of the door body 151 to be spaced apart from each other in the upper-and-lower direction.

The door body 151 includes latches 155 and 156 coupled to the door 30. The latches 155 and 156 include a first latch 155 provided on one side of the door body 151 and a second latch 156 provided on the other side of the door body 151. For example, the first latch 155 may be provided on the left side of the door body 151 and the second latch 156 may be provided on the right side of the door body 151.

The first latch 155 may be disposed between the plurality of hinges 152 in the upper-and-lower direction. The height of the first latch 155 may be equal to that of the second latch 156.

The door 30 includes a first latch coupling portion 35 coupled to the first latch 155 and a second latch coupling portion 36 coupled to the second latch 156. By coupling the latches 155 and 156 to the latch coupling portions 35 and 36, the press door 150 may not move when the clothes treatment apparatus 10 operates. When the press door 150 is closed, the pants P may be easily pressed.

The pants crease management apparatus 100 further includes a film 130 disposed between the press plate 110 and the press door 150 to press the pants P. The film 130 may be made of a flexible material.

The film 130 may be configured to have a relatively small thickness and to have bending rigidity enough not to be easily bent by pressure, thereby providing pressing force to the pants P.

Specifically, the film 130 may be made of a plastic material. For example, the film 130 may be made of polycarbonate, polypropylene, or polyethylene terephthalate (PET).

The thickness of the film 130 is 0.5 to 1.0 mm and the film may be relatively thin. By making the film 130 relatively thin, the user may easily manipulate the film 130. By pressing force applied from the press plate 110 and the press door 150, it is possible to prevent the film 130 from moving in a direction in which the pants P are wrinkled.

The door 30 includes a clip 34 supporting the lower portion of the pants P. The clip 34 is configured to press the front side of the pants P in a state in which the pants are hanged, there preventing the pants P from fluctuating.

The film 130 may be located between both portions, that is, the left and right portions, into which legs are inserted, of the pants P. For example, in FIG. 2, the left portion of the pants may be placed on the front surface of the press plate 110 and the film 130 may be closely brought into contact with the front side of the left portion of the pants P.

The right portion of the pants P is located on the front side of the film 130 and the clip 34 may be fitted into the front lower portion of the right portion of the pants P. That is, the right portion of the pants P may be moved to the back side of the clip 34 to be supported by the clip 34. In addition, the press door 150 may be located on the front side of the clip 34, thereby pressing the pants P.

By this arrangement, a crease may be put in the pants P and wrinkles may be removed by the pants crease management apparatus 100.

Figure 3:
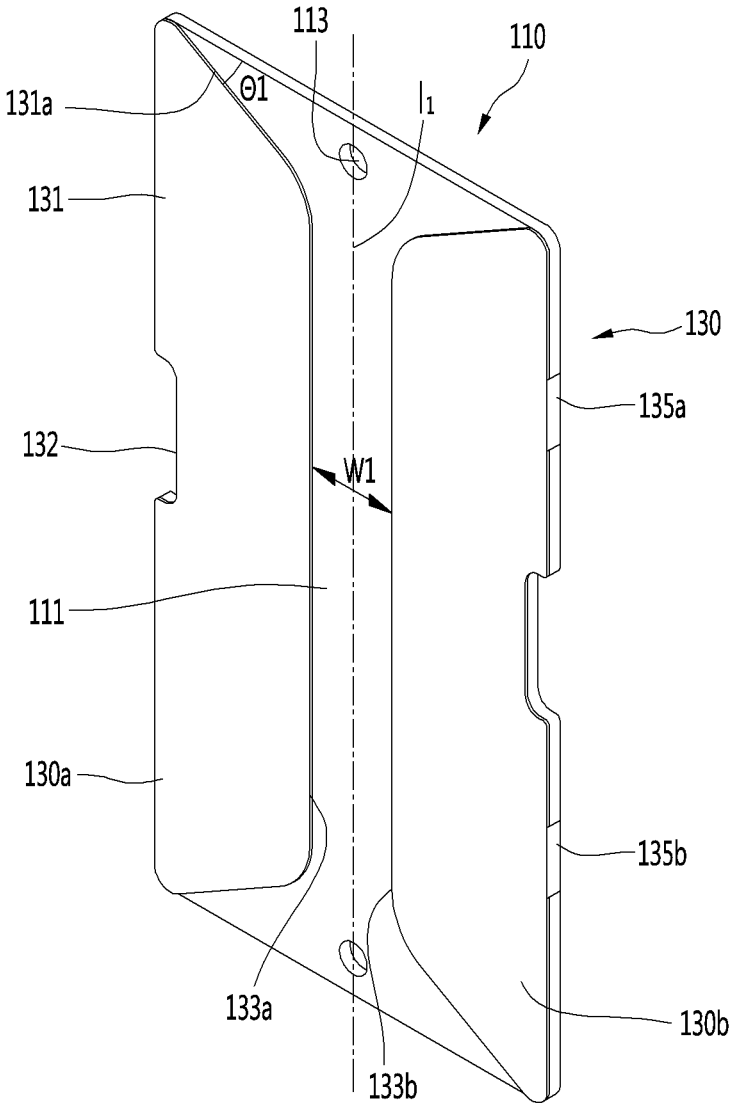
FIG. 3 is a front perspective view showing the configuration of a press plate and a film according to an embodiment of the present disclosure.
Figure 4:
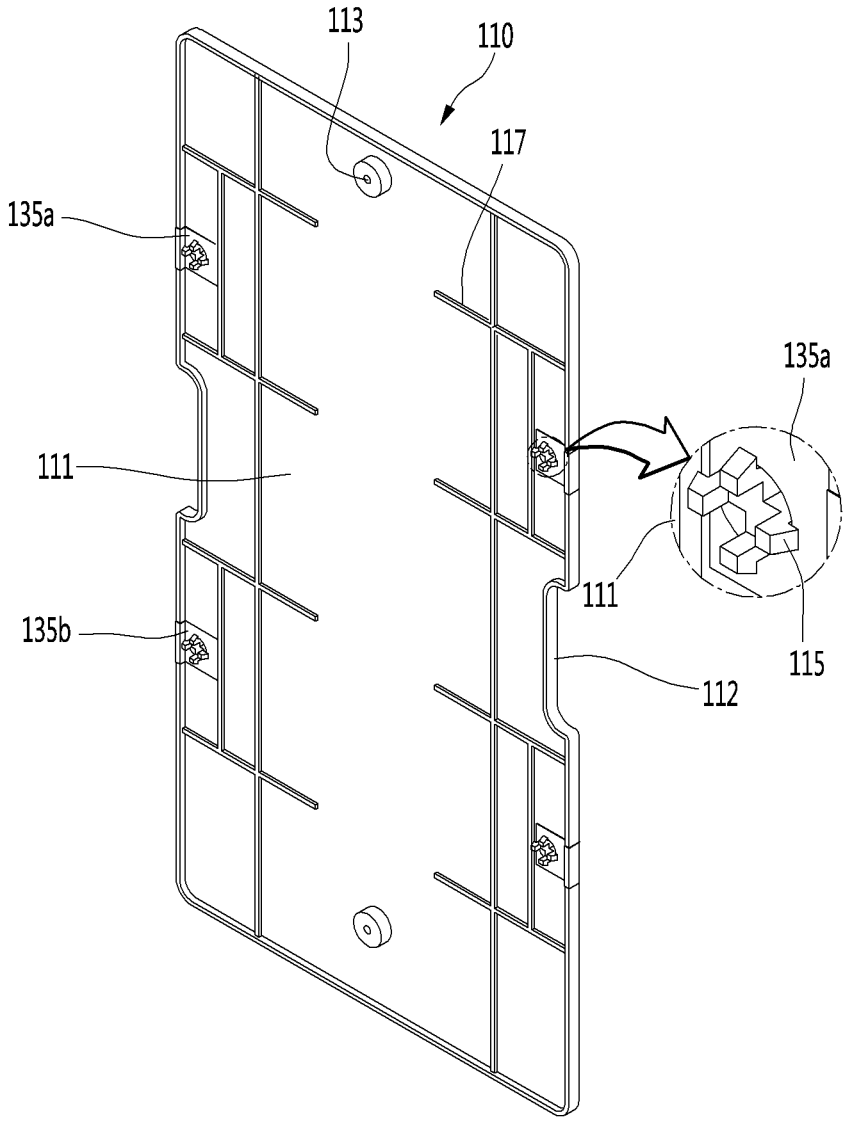
FIG. 4 is a rear perspective view showing the configuration of the press plate and the film according to the embodiment of the present disclosure.
Figure 5:
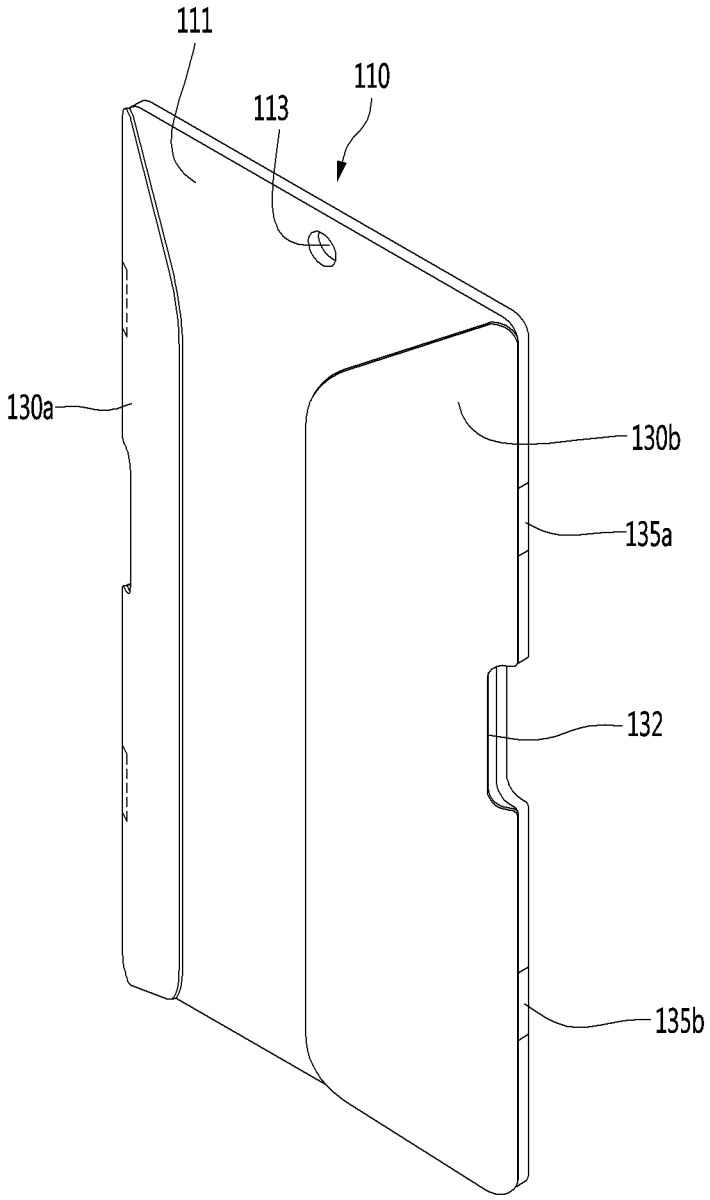
FIG. 5 is a perspective view showing a state in which the film according to the embodiment of the present disclosure moves forward.
Figure 6:
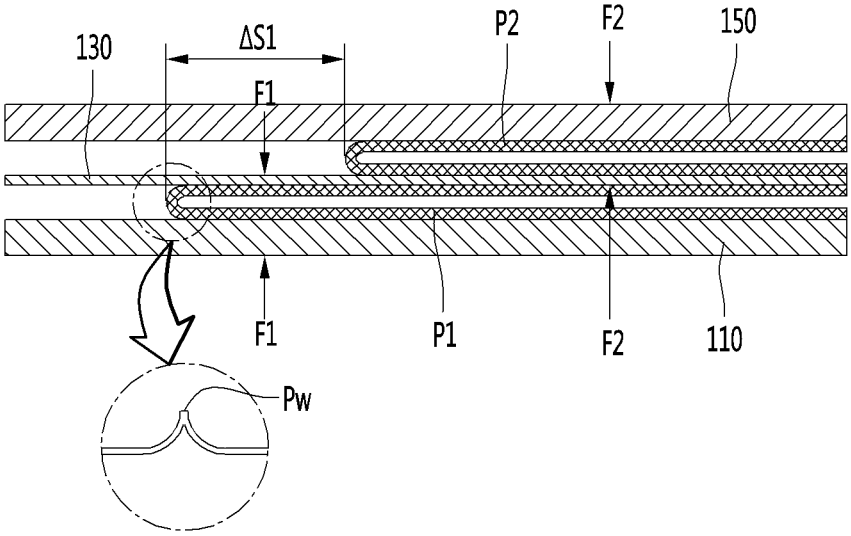
FIG. 6 is a cross-sectional view taken along line VI-VI' of FIG. 1.

FIG. 3 is a front perspective view showing the configuration of a press plate and a film according to an embodiment of the present disclosure, FIG. 4 is a rear perspective view showing the configuration of the press plate and the film according to the embodiment of the present disclosure, FIG. 5 is a perspective view showing a state in which the film according to the embodiment of the present disclosure moves forward, and FIG. 6 is a cross-sectional view taken along line VI-VI' of FIG. 1.

Referring to FIGS. 3 to 6, the press plate 110 according to the embodiment of the present disclosure includes a plate body 111 having a substantially polygonal panel shape. For example, the plate body 111 may have a rectangular panel shape.

The press plate 110 includes a door coupling portion 113 provided in the plate body 111 to be coupled to the door 30. A plurality of door coupling portions 113 may be provided on the upper and lower portions of the plate body 111. The door coupling portion 113 includes a hole, and a fastening member may penetrate through the hole to be coupled to the door 30.

The film 130 may be movably provided on the front side of the press plate 110. The film 130 may be provided on both sides of the press plate 110. Specifically, the film 130 includes a first film portion 130*a* coupled to the left portion of the press plate 110 and a second film portion 130*b* coupled to the right portion of the press plate 110.

The first film portion 130*a* and the second film portion 130*b* may be disposed to be symmetrical with respect to the vertical center line 1 of the press plate 110. For example, the vertical center line 1 may be understood as a line passing through the plurality of door coupling portions 113. Since the first and second film portions 130*a* and 130*b* have the same shape, the first film portion 130*a* will be focused upon and the description thereof is applicable to the second film portion 130*b*.

The first film portion 130*a* includes a film body 131 composed of a thin plastic material. In the film body 131, a film cut-out 132 in which the first latch coupling portion 35 is located is formed. The film cut-out 132 is formed in the left center of the film body 131 in the upper-and-lower direction and is recessed rightward from the left end of the film body 131. By this configuration, when the first film portion 130*a* rotates forward about the left end thereof, the film body 131 may be prevented from interfering with the first latch coupling portion 35.

The film cut-out 132 is formed in the second film portion 130*b*, and the second latch coupling portion 36 of the door 30 may be located in the film cut-out 132 of the second film portion 130*b*.

The press plate 110 further includes a press depression 112 formed at a position corresponding to the film cut-out 132. The plate depression 112 may be configured to be recessed in both sides of the plate body 111, and the first and second latch coupling portions 35 and 36 may be located in both plate depression 112.

The first film portion 130*a* includes film fixing portions 135*a* and 135*b* coupled to the press plate 110. The film fixing portions 135*a* and 135*b* may extend backward from the film body 131 to be coupled to the back surface of the press plate 110. That is, the film body 131 may be located on the front side of the press plate 110, and the film fixing portions 135*a* and 135*b* may be coupled to the back surface of the press plate 110. Since the film 130 is made of a plastic material, such a coupling structure is possible.

Reinforcement ribs 117 for increasing the strength of the press plate 110 is provided on the back surface of the press plate 110. A plurality of reinforcement ribs 117 is provided and may extend to cross each other. By the plurality of reinforcement ribs 117, it is possible to prevent the press plate 110 from being bent.

The film fixing portions 135*a* and 135*b* include a first fixing portion 135*a* provided on the upper portion of the film body 131 and a second fixing portion 135*b* provided on the lower portion of the film body 131. The film cut-out 132 may be formed between the first and second fixing portions 135*a* and 135*b*.

The press plate 110 further includes a hook 115 coupled to the first and second fixing portions 135*a* and 135*b*. The hook 115 may be configured to protrude backward from the back surface of the press plate 110 and to be inserted or hooked into or to the first and second fixing portions 135*a* and 135*b*.

Similarly, the second film portion 130*b* includes the first and second fixing portions 135*a* and 135*b* and the first and second fixing portions 135*a* and 135*b* of the second film portion 130*b* may be coupled to the hook 115 provided on the press plate 110.

The first and second film portions 130*a* and 130*b* may be configured to have a substantially trapezoidal shape. Specifically, the left and right ends of the first and second film portions 130*a* and 130*b* may form the lower and upper sides of the trapezoid parallel to each other, and the upper and lower ends of the first and second film portions 130*a* and 130*b* may form sides connecting the lower and upper sides of the trapezoid.

The first and second film portions 130*a* and 130*b* may be located to be spaced apart from each other. That is, the first side end 133*a* forming the right end of the first film portion 130*a* and the second side end 133*b* forming the left end of the second film portion 130*b* may be spaced apart from each other by a first distance W1. By this configuration, the user may independently manipulate the first and second film portions 130*a* and 130*b* in a state in which the first and second film portions 130*a* and 130*b* do not interfere with each other.

An inclined surface 131*a* inclined downward toward the first side end 133*a* is formed in the upper end of the first film portion 130*a*. The inclined surface 131*a* may extend to be inclined so as to form a set angle 61 with respect to the upper end of the press plate 110. For example, the set angle 61 may be in a range of 30 to 60°. By this configuration, the user may easily grip and manipulate the inclined surface 131*a* of the first film portion 130*a*.

The inclined surface 131*a* may also be formed in the upper end of the second film portion 130*b*.

Referring to FIG. 5, the film body 131 of each of the first film portion 130*a* and the second film portion 130*b* may move in a direction forward away from the front surface of the press plate 110.

That is, by the material characteristics of the film 130, the film body 131 provided in each of the first and second film portions 130*a* and 130*b* may move forward from the first and second fixing portions 135*a* and 135*b*. Accordingly, the user may hang the pants P and then move the film 130 forward such that the film is sandwiched between both portions of the pants P.

Referring to FIG. 6, the film 130 may be disposed between both portions, that is, the first side portion P1, into which the left leg is inserted, and the second side portion P2, into which the right leg is inserted, of the pants P. Substantially, it is not easy to accurately align the first side portion P1 and the second side portion P2 in a line in a state in which the first and second side portions are placed in the pants crease management apparatus 100. As shown in FIG. 6, the first and second side portions are spaced apart from each other by a predetermined distance ΔS1 in the left-and-right direction.

In a state in which the press door 150 is closed, the first side portion P1 is pressed by force F1 applied between the press plate 110 and the film 130, and the second side portion P2 may be pressed by force F2 applied between the film 130 and the press door 150. That is, since pressing force F1+F2 is applied to the pants P, round wrinkles appearing when pressing force is small may be prevented and a crease Pw may be formed. In addition, wrinkles of the other portion of the pants P may be removed.

Figure 7A:
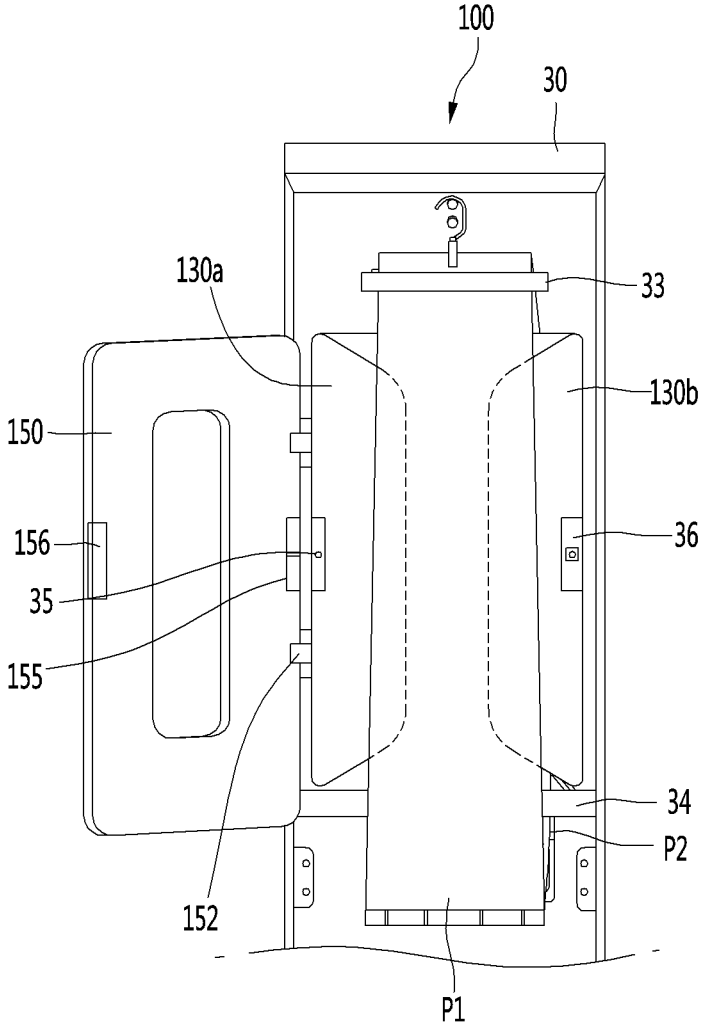
FIGS. 7A and 7B are diagrams showing a state of operating the pants crease management apparatus according to the embodiment of the present disclosure.
Figure 7B:
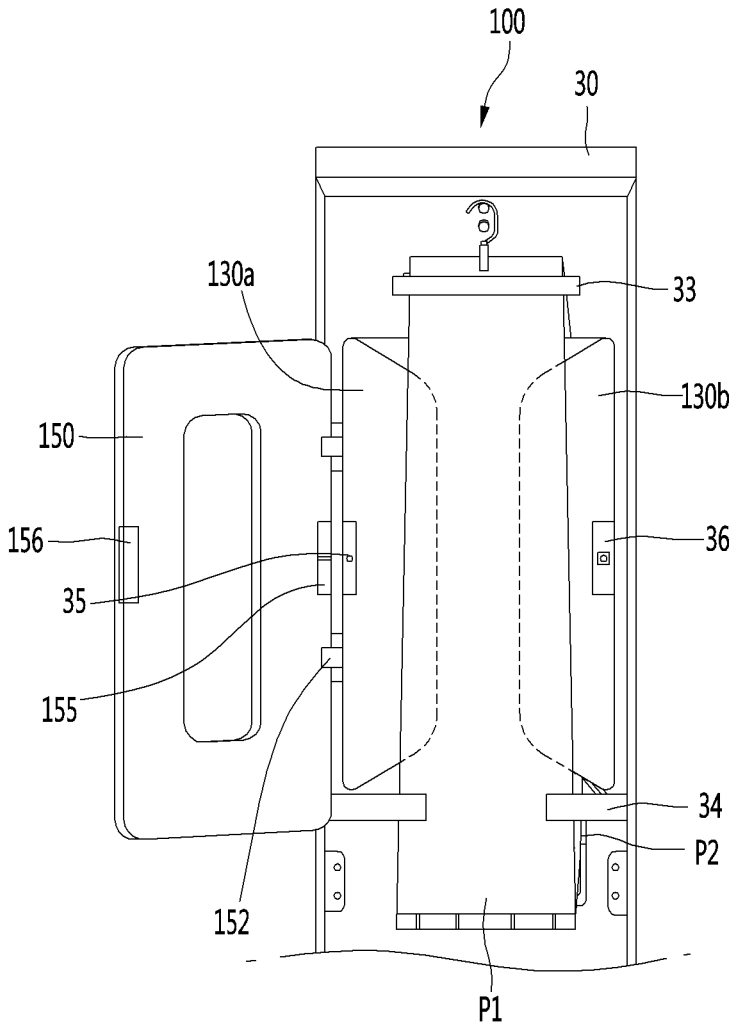

FIGS. 7A and 7B are diagrams showing a state of operating the pants crease management apparatus according to the embodiment of the present disclosure. The order of operating the pants crease management apparatus 100 will be described.

The pants P are hanged on the pants hanger 32 and the first side portion P1 of the pants P is located on the press plate 110. In addition, the film 130 is sandwiched between the first and second side portions P1 and P2 and the front surface of the first side portion P1 is pressed. By this operation, first pressing force F1 may be applied from the film 130 to the first side portion P1 (FIG. 7A).

The second side portion P2 of the pants P is located on the front side of the film 130 and the lower portion of the second side portion P2 may be fitted into the back side of the clip 34 (FIG. 7B). When the press door 150 is closed, the press door 150 presses the second side portion P2 backward, and second pressing force may be applied from the film 130 to the second side portion P2 (FIG. 7B).

By operation of the pants crease management apparatus 10, it is possible to put a crease in the first and second side portions of the pants P and to remove wrinkles.

According to the present disclosure, since both portions of pants are disposed with a film interposed therebetween and are pressed by the film, it is possible to reduce movement of the pants when a crease is put in the pants.

In addition, since the film is formed of plastic resin, for example, polycarbonate, polypropylene or polyethylene terephthalate (PET), it is possible to press the pants while the film is not easily deformed by heat.

In addition, since a plurality of films is movably provided on both sides of the press plate, it is possible to easily press both portions of the pants, in which a crease is put.

In addition, since both side ends of the film are spaced apart from each other such that the pants are exposed to the outside of the film, it is possible to easily apply the environment (high-temperature/high-humidity environment such as steam and hot air) of the treatment chamber of the clothes treatment apparatus to the pants.

In addition, since the upper end of the film is inclined downward, it is possible to easily dispose the pants on both sides of the film.

In addition, since the film is hooked to both sides of the press plate, the film may move in a state of being firmly supported by the pants crease management apparatus.

What is claimed is:

1. A clothes treatment apparatus comprising:

a cabinet including a treatment chamber defined by a space formed by inner walls of the cabinet;

a door coupled to the cabinet and including an inner surface providing a space for mounting pants, and configured to open or close the treatment chamber;

a press door coupled to be movable relative to the door, and configured to press pants; and a film disposed between the inner surface of the door and the press door, the film being configurable to be inserted between a left leg portion of pants and a right leg portion of pants, and the film being formed of a flexible material.

2. The clothes treatment apparatus of claim 1, wherein the film is formed of a plastic material including at least one of a polycarbonate material, a polypropylene material, a polyethylene terephthalate (PET) material, or another flexible plastic material.

3. The clothes treatment apparatus of claim 2, wherein a thickness of the film is in a range from 0.5 to 1.0 mm.

4. The clothes treatment apparatus of claim 1, wherein the film is configured to be movable from the inner surface of the door in a direction perpendicular to the inner surface of the door.

5. The clothes treatment apparatus of claim 1, further comprising a press plate including one surface coupled to the inner surface of the door and the other surface coupled to the film.

6. The clothes treatment apparatus of claim 1, wherein the press door includes:

a door body having a through hole;

a hinge provided on one side of the door body and coupled to the door, and configured to rotatably support the door body; and a latch provided on the other side of the door body, and configured to fix the door body to the inner surface of the door selectively, and wherein the door includes a latch coupling portion coupled to the latch selectively.

7. The clothes treatment apparatus of claim 6, wherein the film includes:

a film body disposed on the inner surface of the door; and a film cut-out recess formed in the film body to position the latch coupling portion.

8. The clothes treatment apparatus of claim 1, further comprising a pants hanger disposed on the inner surface of the door, and configured to spread pants downward.

9. The clothes treatment apparatus of claim 8, further comprising a clip located below the pants hanger, and configured to press a lower portion of pants.

10. The clothes treatment apparatus of claim 9, wherein the clip is located below the film.

11. The clothes treatment apparatus of claim 1, wherein as the film extends in the width direction of the door from one of a left side of the inner surface of the door or a right side of the inner surface of the door, a height formed in a height direction of the door decreases.

12. The clothes treatment apparatus of claim 1, wherein the film is fixed to a left side of the inner surface of the door or a right side of the inner surface of the door and extends in a width direction of the door to form a fixed end and a free end.

13. The clothes treatment apparatus of claim 12, wherein the film includes an inclined surface inclined downward from an upper end of the fixed end to an upper end of the free end, or inclined upward from a lower end of the fixed end to a lower end of the free end.

14. The clothes treatment apparatus of claim 1, wherein the film includes:

a first film portion extended from a left side of the inner surface of the door in a width direction of the door; and a second film portion extended from a right side of the inner surface of the door in the width direction of the door, and wherein as each of the first film portion and the second film portion extends in the width direction of the door, a height formed in a height direction of the door decreases.

15. The clothes treatment apparatus of claim 1, wherein the film includes:

a first film portion fixed to a left side of the inner surface of the door; and a second film portion fixed to a right side of the inner surface of the door, and wherein each of the first film portion and the second film portion extends in a width direction of the door to form a fixed end and a free end.

16. The clothes treatment apparatus of claim 15, wherein as at least one of the first film portion and the second film portion extends from the fixed end to the free end, a height formed in a height direction of the door decreases.

17. The clothes treatment apparatus of claim 15, wherein at least one of the first film portion and the second film portion includes an inclined surface inclined downward from an upper end of the fixed end to an upper end of the free end or inclined upward from a lower end of the fixed end to a lower end of the free end.

18. The clothes treatment apparatus of claim 15, wherein the first film portion and the second film portion are disposed to be symmetrical with respect to a vertical center line of the inner surface of the door.

19. The clothes treatment apparatus of claim 1, wherein a width of the film is smaller than a width of the press door.

20. The clothes treatment apparatus of claim 1, wherein before the press door presses pants fixed with respect to the inner surface of the door, the film is being configured to insert between the left leg portion of pants and the right leg portion of pants.

21. A clothes treatment apparatus comprising:

a cabinet including a treatment chamber defined by a space formed by inner walls of the cabinet; and a pants crease management apparatus being configured to press pants, wherein the pants crease management apparatus includes:

a press plate being configured to provide a space for pressing pants;

a press door rotatable relative to the press plate; and a film disposed between the press plate and the press door, the film being configurable to be inserted between a left leg portion of pants and a right leg portion of pants, and the film being formed of a flexible material.

22. The clothes treatment apparatus of claim 21, further comprising a door rotatably coupled to the cabinet, being configured to form part of the treatment chamber, and wherein the pants crease management apparatus is located at the treatment chamber.

23. The clothes treatment apparatus of claim 21, wherein the film is formed of a plastic material including at least one of a polycarbonate material, a polypropylene material, a polyethylene terephthalate (PET) material, or another flexible plastic material.

24. The clothes treatment apparatus of claim 21, wherein a thickness of the film is in a range from 0.5 to 1.0 mm.

25. The clothes treatment apparatus of claim 21, wherein as the film extends in the width direction of the door from one of a left side of the inner surface of the door or a right side of the inner surface of the door, a height formed in a height direction of the door decreases.

26. The clothes treatment apparatus of claim 21, wherein the film is fixed to a left side of the inner surface of the door or a right side of the inner surface of the door and extends in a width direction of the door to form a fixed end and a free end.

27. The clothes treatment apparatus of claim 26, wherein the film includes an inclined surface inclined downward from an upper end of the fixed end to an upper end of the free end, or inclined upward from a lower end of the fixed end to a lower end of the free end.

28. The clothes treatment apparatus of claim 21, wherein the film includes:

a first film portion extended from a left side of the inner surface of the door in a width direction of the door; and a second film portion extended from a right side of the inner surface of the door in the width direction of the door, and wherein as each of the first film portion and the second film portion extends in the width direction of the door, a height formed in a height direction of the door decreases.

29. The clothes treatment apparatus of claim 21, wherein the film includes:

a first film portion fixed to a left side of the inner surface of the door; and a second film portion fixed to a right side of the inner surface of the door, and wherein each of the first film portion and the second film portion extends in a width direction of the door to form a fixed end and a free end.

30. The clothes treatment apparatus of claim 29, wherein as at least one of the first film portion and the second film portion extends from the fixed end to the free end, a height formed in a height direction of the door decreases.

31. The clothes treatment apparatus of claim 29, wherein at least one of the first film portion and the second film portion includes an inclined surface inclined downward from an upper end of the fixed end to an upper end of the free end or inclined upward from a lower end of the fixed end to a lower end of the free end.

32. The clothes treatment apparatus of claim 29, wherein the first film portion and the second film portion are disposed to be symmetrical with respect to a vertical center line of the inner surface of the door.

33. The clothes treatment apparatus of claim 21, wherein a width of the film is smaller than at least one of a width of the press plate or a width of the press door.

34. The clothes treatment apparatus of claim 21, wherein before the press door presses pants fixed with respect to the press plate, the film is being configured to insert between the left leg portion of pants and the right leg portion of pants.

* * * * *